US009245477B2

(12) United States Patent
Kwack et al.

(10) Patent No.: US 9,245,477 B2
(45) Date of Patent: Jan. 26, 2016

(54) FLEXIBLE DISPLAY DEVICE AND DRIVING METHOD THEREOF

(71) Applicant: Samsung Display Co., Ltd., Yongin, Gyeonggi-Do (KR)

(72) Inventors: Jun-Ho Kwack, Yongin (KR); Joon-Sam Kim, Yongin (KR); Jong-Hwan Kim, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 153 days.

(21) Appl. No.: 13/668,017

(22) Filed: Nov. 2, 2012

(65) Prior Publication Data

US 2014/0002430 A1 Jan. 2, 2014

(30) Foreign Application Priority Data

Jun. 27, 2012 (KR) ..... 10-2012-0069209

(51) Int. Cl.
*G09G 5/00* (2006.01)
*G09G 3/32* (2006.01)

(52) U.S. Cl.
CPC ..... *G09G 3/3225* (2013.01); *G09G 2380/02* (2013.01)

(58) Field of Classification Search
USPC ..... 345/207
See application file for complete search history.

(56) References Cited

U.S. PATENT DOCUMENTS 5,946,836 A * 9/1999 Sahebolamri ..... 40/471
7,095,387 B2 * 8/2006 Lee et al. ..... 345/4
8,096,068 B2 1/2012 Van Rens
8,174,628 B2 * 5/2012 Matsushita et al. ..... 348/836
8,227,795 B2 * 7/2012 Lee et al. ..... 257/40
2005/0176470 A1 * 8/2005 Yamakawa ..... 455/566
2006/0020469 A1 * 1/2006 Rast ..... 704/270
2006/0181552 A1 * 8/2006 Hopple ..... 345/690

(Continued)

FOREIGN PATENT DOCUMENTS

CN 1833194 A 9/2006
CN 201655172 U 11/2010

(Continued)

OTHER PUBLICATIONS

Korean Office Action dated Sep. 16, 2013 for Korean Patent Application No. KR 10-2012-0069209 which corresponds to captioned U.S. Appl. No. 13/668,017.

*Primary Examiner* — Seokyun Moon
*Assistant Examiner* — Josemarie G Acha, III
(74) *Attorney, Agent, or Firm* — Knobbe Martens Olson & Bear LLP

(57) ABSTRACT

A display device which displays an image having a size corresponding to a display area exposed outside a housing is disclosed. In one aspect, the display device includes a flexible display panel having a recognition pattern, a housing, and a light-receiving sensor. The recognition pattern includes a plurality of self-luminous indicators arranged according to a first direction, and having different colors or different light-emitting intensities. The housing is coupled to the flexible display panel for entering/discharging of the flexible display panel according to the first direction such that a display area of the flexible display panel is variously exposed. The light-receiving sensor is positioned corresponding to the recognition pattern in the housing and respectively recognizes a plurality of indicators to sense the exposed display area of the flexible display panel.

16 Claims, 13 Drawing Sheets

(56) References Cited

U.S. PATENT DOCUMENTS

| | | | | |
|---|---|---|---|---|
| 2008/0150885 | A1* | 6/2008 | Overwijk et al. | 345/107 |
| 2008/0204437 | A1* | 8/2008 | Jensen | G01J 1/02 345/207 |
| 2009/0096745 | A1* | 4/2009 | Sprague | G09G 3/344 345/107 |
| 2010/0033435 | A1* | 2/2010 | Huitema | 345/173 |
| 2011/0043479 | A1 | 2/2011 | van Aerle et al. | |
| 2011/0050645 | A1* | 3/2011 | Lee | G06F 3/0412 345/175 |
| 2011/0227855 | A1* | 9/2011 | Kim et al. | 345/173 |
| 2012/0169765 | A1* | 7/2012 | Xu | G06F 1/1647 345/619 |

FOREIGN PATENT DOCUMENTS

| | | | |
|---|---|---|---|
| CN | 102239683 | A | 11/2011 |
| CN | 102496684 | A | 6/2012 |
| JP | 11-143386 | A | 5/1999 |
| JP | 11-272205 | A | 10/1999 |
| JP | 2002-182582 | A | 6/2002 |
| JP | 2004-279867 | A | 10/2004 |
| JP | 2005-215320 | A | 8/2005 |
| JP | 2006-509249 | A | 3/2006 |
| JP | 2007-286094 | A | 11/2007 |
| JP | 2008-171148 | A | 7/2008 |
| JP | 2010-003600 | A | 1/2010 |
| JP | 2010-224480 | A | 10/2010 |
| JP | 2011-034087 | A | 2/2011 |
| JP | 2011-221189 | A | 11/2011 |
| JP | 2012-113048 | A | 6/2012 |
| KR | 10-2011-0048705 | A | 5/2011 |
| KR | 10-2011-0105574 | A | 9/2011 |
| KR | 10-2013-0017313 | A | 2/2013 |
| TW | M396429 | U1 | 1/2011 |
| WO | WO 2004/084171 | A1 | 9/2004 |
| WO | WO 2008/108645 | A1 | 9/2008 |

* cited by examiner

FLEXIBLE DISPLAY DEVICE AND DRIVING METHOD THEREOF

CROSS-REFERENCE TO RELATED APPLICATIONS

This application claims priority to and the benefit of Korean Patent Application No. 10-2012-0069209 filed in the Korean Intellectual Property Office on Jun. 27, 2012, the entire contents of which are incorporated herein by reference.

BACKGROUND

1. Field

The described technology relates generally to a display device. More particularly, the described technology relates generally to a display device having a flexible display panel, and a driving method thereof.

2. Description of the Related Technology

A flexible display panel may be rolled onto a roller installed inside a housing. In this case, the flexible display panel may be drawn out of the housing by rotation in one direction of the roller and may be returned to the housing by rotation of the roller in an opposite direction.

The flexible display panel has a display area that is exposed and changed as it is moved into or out of the housing, and thus it is necessary to display an image with a size corresponding to the exposed display area. For this, the display device must correctly recognize the size of the display area that outside the housing.

The above information disclosed in this Background section is only for enhancement of understanding of the background of the described technology and therefore it may contain information that does not form the prior art that is already known in this country to a person of ordinary skill in the art.

SUMMARY OF CERTAIN INVENTIVE ASPECTS

A display device displaying an image with a size corresponding to an exposed display area by correctly detecting the size of the display area exposed outside a housing, and a driving method thereof is disclosed.

One disclosed aspect relates to a display device comprising: a flexible display panel moveable along a first direction, comprising a recognition pattern, the recognition pattern comprising a plurality of indicators; a housing coupled to the flexible display panel, configured such that as the flexible display panel is withdrawn from the housing or retracted into the housing along the first direction, a display area of the flexible display panel, is variably exposed; and a light-receiving sensor positioned in the housing corresponding to the recognition pattern configured to recognize one of the plurality of indicators and sense the exposed display area of the flexible display panel.

In some embodiments, a controller is connected to the light-receiving sensor and the flexible display panel configured to generate an image signal corresponding to the display area of the flexible display panel sensed by the light-receiving sensor to the flexible display panel.

In some embodiments, the controller includes a storage unit storing image size data respectively corresponding to the display area of the flexible display panel.

In some embodiments, the display area of the flexible display panel includes a display area comprising a plurality of pixels configured to display an image and a non-display area near the display area, and wherein the recognition pattern is positioned in the non-display area.

In some embodiments, the plurality of indicators are formed with the same structure as the pixel of the display area, and include subpixels of red, green, and blue.

In some embodiments, a portion of pixels of the plurality of pixels formed in the flexible display panel are respectively allocated as indicators.

In some embodiments, the plurality of indicators include a driving circuit unit and an organic light emitting diode (OLED) connected to the driving circuit unit.

In some embodiments, the plurality of indicators respectively have different colors, and the light-receiving sensor is configured to sense the color of the plurality of indicators.

In some embodiments, the plurality of indicators respectively have different light-emitting intensities, and the light-receiving sensor includes a light-receiving photosensor configured to sense the light intensity of the plurality of indicators.

In some embodiments, the plurality of indicators represent the same color and have light-emitting intensity that varies gradually along the first direction.

In some embodiments, the display device further comprises a roll part positioned inside the housing and fixing one end of the flexible display panel; and a fixing member fixing the other end of the flexible display panel.

In some embodiments, the display device further comprises a pair of approach sensors, wherein one of the pair of approach sensors is installed in housing and the other of the pair of approach sensors is installed in the fixing member toward the housing, the pair of approach sensors configured to sense when the flexible display panel is disposed substantially entirely within housing, based on the distance between the housing and the fixing member.

Some embodiments described herein include a method of driving a display device comprising providing the display device described herein; activating the plurality of indicators; recognizing one indicator among the plurality of indicators using the light-receiving sensor to determine an exposed display area of the flexible display panel; generating an image signal corresponding to the display area; and displaying the image in the display area of the flexible display panel.

In some embodiments, the method further comprises inactivating the indicators among the plurality of indicators exposed outside the housing before the flexible display panel displays the image.

In some embodiments, the method further comprises: determining whether another indicator is sensed after the flexible display panel displays the image, and activating the plurality of indicators if another indicator is not sensed with reference to the currently sensed indicator.

Some embodiments described herein include a method of driving a display device, comprising providing the display device as described herein; determining whether an approach sensor is in an open state; activating a plurality of indicators if the approach sensor is in the open state; recognizing one indicator among the plurality of indicators through the light-receiving sensor to sense an exposed display area of the flexible display panel; generating an image signal corresponding to the display area; displaying an image from the image signal on the display area of the flexible display panel; and determining whether the approach sensor is in a closed state to inactivate the plurality of indicators if the approach sensor is in the closed state, thereby initiating a power-saving mode.

In some embodiments, the method further comprises inactivating the indicators among the plurality of indicators which are exposed outside the housing before the flexible display panel displays the image.

In some embodiments, after the flexible display panel displays the image, determining whether another indicator is sensed with reference to the currently sensed indicator; and activating a plurality of indicators if another indicator is not sensed with reference to the currently sensed indicator.

According to an exemplary embodiment, the indicator corresponding to the light-receiving sensor is sensed in real-time such that the display area of the flexible display panel corresponding to each indicator may be correctly recognized. An image of a size corresponding to the exposed display area may be displayed without an additional configuration when the power is suddenly turned off and on or when the flexible display panel is unfolded and a part of it is folded.

DETAILED DESCRIPTION OF CERTAIN ILLUSTRATIVE EMBODIMENTS

Figure 1:
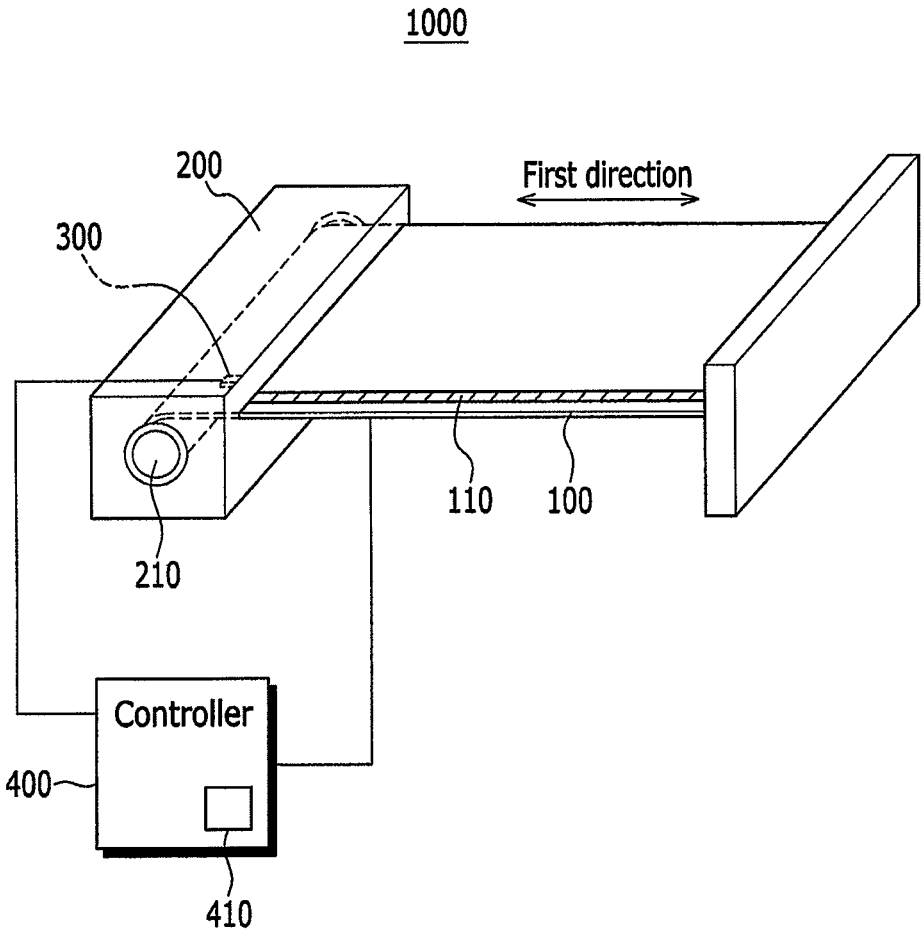
FIG. 1 is a perspective view of a display device according to the first exemplary embodiment.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In order to clarify the present invention, parts that are not connected with the description will be omitted, and the same elements or equivalents are referred to by the same reference numerals throughout the specification. Further, since sizes and thicknesses of constituent members shown in the accompanying drawings are given for better understanding and ease of description, the present invention is not limited to the illustrated sizes and thicknesses.

In the drawings, the thickness of layers, films, panels, regions, etc., are exaggerated for clarity. In the drawings, for better understanding and ease of description, the thicknesses of some layers and areas are exaggerated. It will be understood that when an element such as a layer, film, region, or substrate is referred to as being "on" another element, it can be directly on the other element or intervening elements may also be present.

FIG. 1 is a perspective view of an embodiment of a display device.

Referring to FIG. 1, a display device 1000 according to the first exemplary embodiment includes a flexible display panel 100, a housing 200, a light-receiving sensor 300, and a controller 400.

The flexible display panel 100 comprises a flexible film such as a plastic film, and an OLED, which is disposed on the flexible film capable of displaying an image. The flexible display panel 100 transmits light when not displaying the image such that a transparent state may be maintained. Also, a touch film sensing a touch operation of a user may be attached to a front surface of the flexible display panel 100.

The flexible display panel 100 is connected to the controller 400 and displays the image by an electrical signal output from the controller 400. One end of the flexible display panel 100 is coupled to the housing 200 such that the flexible display panel 100 may be drawn out of the housing 200 or may be received inside the housing 200. Flexible display panel 100 is withdrawn from the housing 200 according to a first direction, and as flexible display panel 100 is withdrawn, the area of the flexible display panel 100 that is exposed outside the housing 200 changes, and thus the display area changes size and/or shape.

Figure 2:
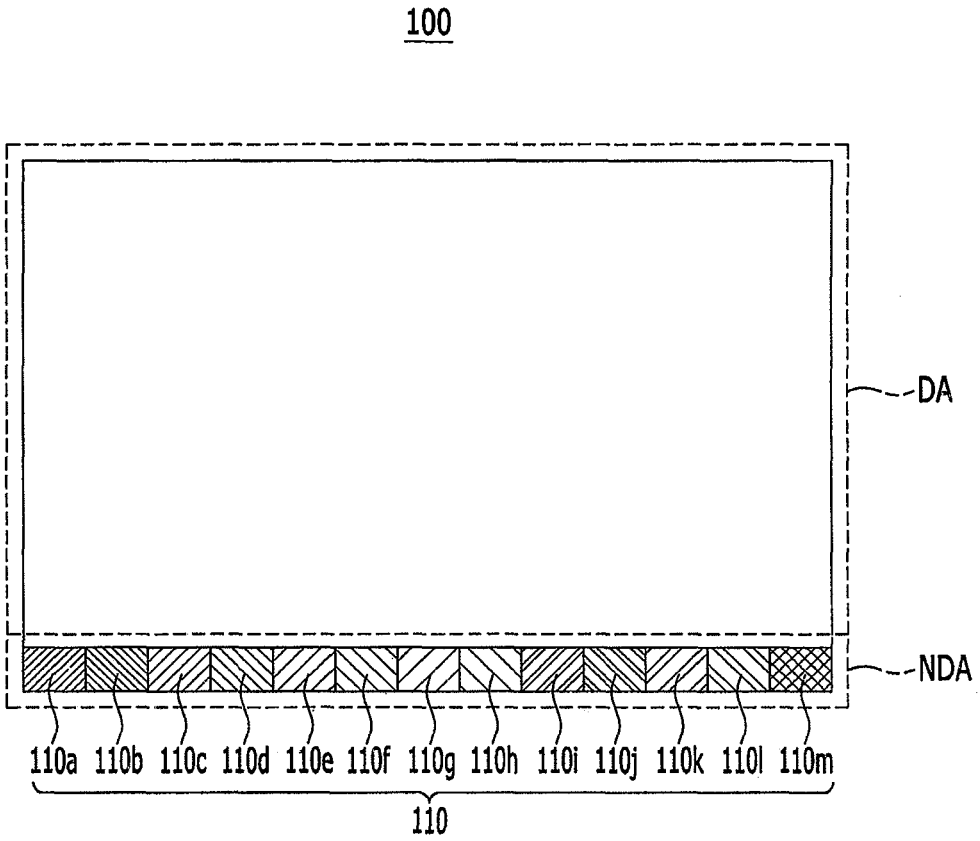
FIG. 2 is a frontal view of the flexible display panel shown in FIG. 1.

FIG. 2 is a front view of the flexible display panel shown in FIG. 1.

Referring to FIG. 1 and FIG. 2, the flexible display panel 100 includes a display area DA including a plurality of pixels and displaying the image, a non-display area NDA near the display area DA, and a recognition pattern 110 disposed on the non-display area NDA.

The recognition pattern 110 includes a plurality of indicators (110*a*-110*m*) arranged an axis which is parallel to the first direction which corresponds to the direction in which the flexible display panel 100 withdrawn. Each indicator (110*a*-110*m*) functions as a unique address to recognize the display area or the amount of display area of the flexible display panel 100 exposed outside the housing 200. The plurality of indicators (110*a*-110*m*) may display different colors respectively.

In detail, the plurality of indicators (110*a*-110*m*) display a predetermined color regardless of the image displayed to the display area DA. That is, a predetermined color is always displayed by a particular indicator (110*a*-110*m*) from the time that power is applied regardless of whether an image is being displayed on the display area DA, as long as an interrupt is not generated. The plurality of indicators (110*a*-110*m*) are self-luminous, for example, the plurality of indicators (110*a*-110*m*) may be formed having a structure similar to that of a pixel of the display area DA.

One pixel of the display area DA includes subpixels of red, green, and blue, and the light-emitting intensity of the three subpixels is controlled thereby producing a display capable of displaying a full range of colors. Each of the indicators (110*a*-110*m*) includes subpixels of red, green, and blue, and the light-emitting intensity of the three subpixels may be controlled to control the color of the indicator.

The indicators (110*a*-110*m*) have a structure like the pixels of the display area DA such that each indicator is not separately formed, and the indicators may be a portion or subset of the pixels of display area DA. The pixels of the display area DA and the pixels of the non-display area NDA (i.e., the indicators (110*a*-110*m*) which comprise recognition pattern 110) may be separately controlled through software.

The recognition pattern 110 is positioned at the edge of the display area DA and consists of the pixels of one line or a plurality of lines parallel to the first direction. In FIG. 1 and FIG. 2, with reference to the drawings, the recognition pattern 110 is positioned on a lower portion of the flexible display panel 100. However the recognition pattern 110 may be positioned on an upper portion of the flexible display panel 100.

The width of each indicator (110*a*-110*m*), corresponding to the first direction may be equal to or larger than the width of one pixel disposed in the display area DA. That is, one indicator (110*a*-110*m*) may consist of one pixel or a plurality of pixels. In the latter case, the controller 400 applies the same data signal to all the pixels of one indicator disposed adjacent to each other in the non-display area NDA such that a plurality of pixels may display the same color. The detailed structure of the indicators (110*a*-110*m*) will be described later.

Again referring to FIG. 1, the housing 200 includes a roll part 210 for winding the flexible display panel 100. The roll part 210 is positioned inside the housing 200 and is fixed to one end of the flexible display panel 100. When the roll part 210 is rotated in one direction, the roll part 210 unwinds the flexible display panel 100 such that the flexible display panel 100 may be drawn outside the housing 200, while when the roll part 210 is rotated in the reverse direction, the roll part 210 winds the flexible display panel 100 such that the flexible display panel 100 is received into the housing 200. The roll part 210 may be manually operated by a user or may be automatically rotated by a driving means such as a motor.

Figure 3:
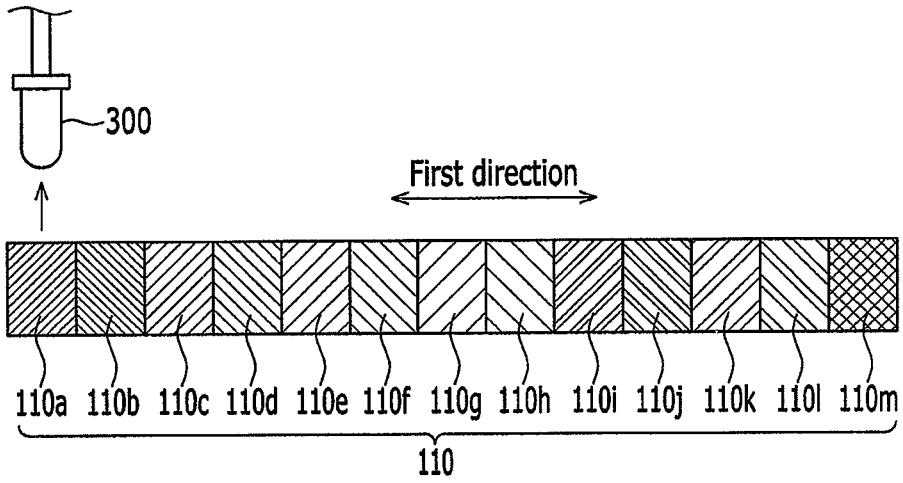
FIG. 3 is a view illustrating a sensing method of the display device shown in FIG. 1.

FIG. 3 is a view illustrating a sensing method of the display device shown in FIG. 1.

Referring to FIG. 1 and FIG. 3, the light-receiving sensor 300 is positioned inside the housing 200 and aligns with the recognition pattern 110. Light-receiving sensor 300 is made of a color sensor that senses a color or colors emanating from one or more of the indicators 110*a*-110*m* comprising recognition pattern 110. When withdrawing or extracting the flexible display panel 100 according to the first direction, the light-receiving sensor 300 receives the light emitted from the indicator (110*a*-110*m*) passing thereunder thereby senses the color of the received light.

In some embodiments, the light-receiving sensor 300 includes three sensors sensing red light, green light, and blue light. The intensity of the red light, the green light, and the blue light sensed by the sensor are combined such that the color of the received light can be detected with high sensitivity.

Each of the indicators (110*a*-110*m*) functions as a unique address corresponding to a position on flexible display panel 100, which allows the controller to recognize the amount of exposed display area of the flexible display panel 100, The sensing of a particular indicator (110*a*-110*m*) by the light-receiving sensor 300 thus corresponds to the amount of exposed display area of the flexible display panel 100. For example, when the light-receiving sensor 300 senses the blue indicator among a plurality of indicators (110*a*-110*m*), the display device 1000 senses the region of the flexible display panel 100 that is unfolded with reference to the blue indicator.

The detection signal of the light-receiving sensor 300 is transmitted to the controller 400, and the controller 400 controls the size of the image to correspond to the size of the exposed display area of flexible display area 100.

Figure 4:
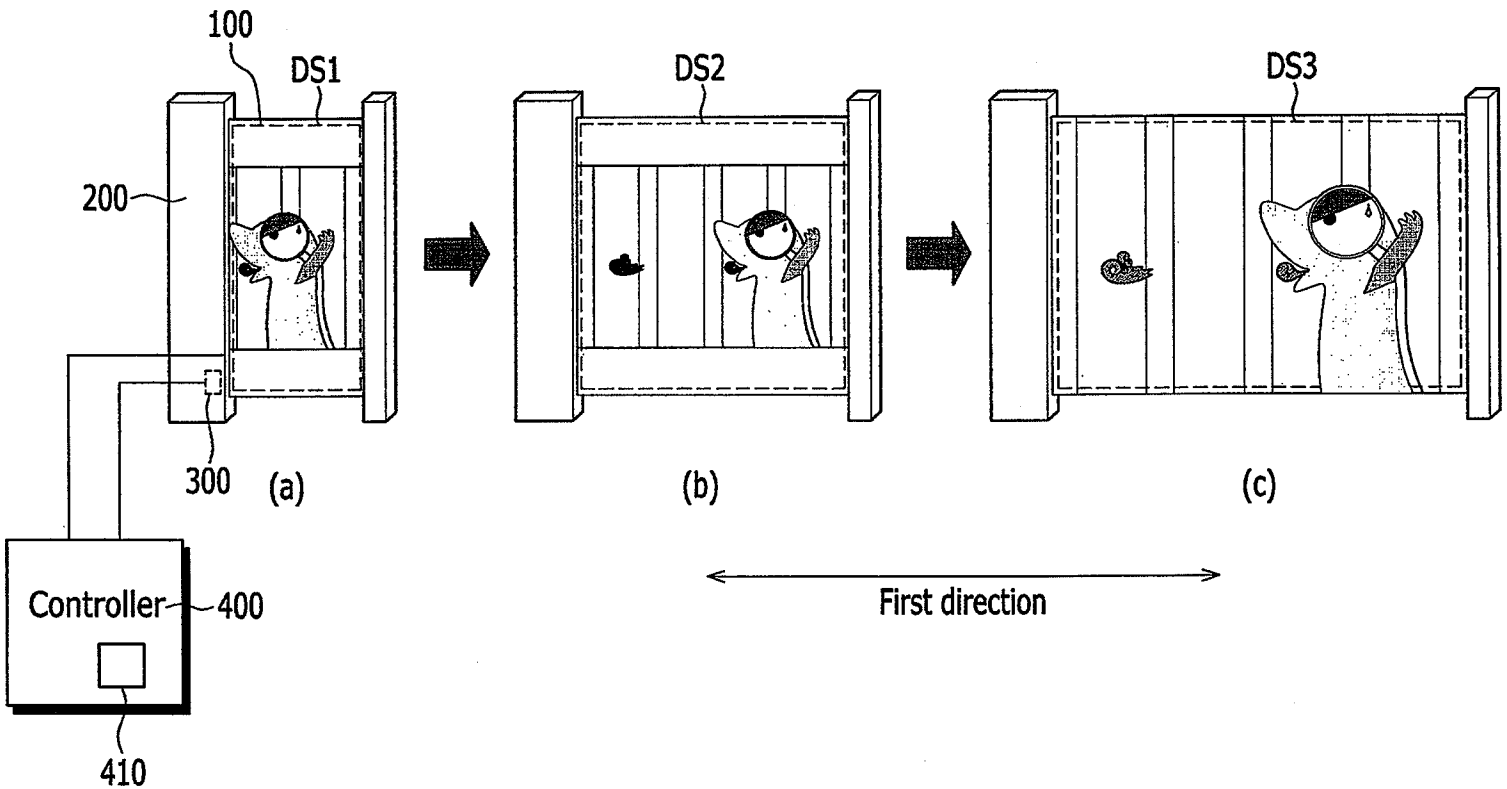
FIG. 4 is a view illustrating an image control method of the display device shown in FIG. 1.

FIG. 4 is a view illustrating an image control method of the display device shown in FIG. 1. Referring to FIG. 4, the controller 400 is connected to the light-receiving sensor 300 and the flexible display panel 100 to generate an image signal corresponding to the exposed display area of the flexible display panel 100 that is sensed by the light-receiving sensor 300, and outputs the image signal to the flexible display panel 100. The controller 400 includes a storage unit 410, and the storage unit 410 stores image size data respectively corresponding to the plurality of indicators (110*a*-110*m*) (i.e., respectively corresponding to the exposed display area). The storage unit 410 can be a volatile or non-volatile storage medium.

In detail, as shown in FIG. 4 step (a), if the flexible display panel 100 is drawn out according to the first direction such that a first display area DS1 is exposed, the light-receiving sensor 300 senses the color of the indicator (110*a*-110*m*) passing under the light-receiving sensor 300 at the time that the first display area DS1 is exposed. The light-receiving sensor 300 identifies one the plurality of indicators (110*a*-110*m*) and transmits a detection signal to the controller 400, corresponding to the sensed indicator and, accordingly, the first display area DS1. The controller 400 receives the detection signal of the light-receiving sensor 300 and loads the image size data corresponding to the first display area DS1 stored in the storage unit 410 to generate an image signal of a first size corresponding to the first display area DS1 and to output it to the flexible display panel 100.

Also, as shown in FIG. 4 step (b), as the flexible display panel 100 is drawn further out according to the first direction such that a second display area DS2 that is larger than the first display area DS1 is exposed, the light-receiving sensor 300 senses the color of the indicator (110*a*-110*m*) passing under the light-receiving sensor 300 at the time that the second display area DS2 is exposed. The light-receiving sensor 300 identifies one the plurality of indicators (110*a*-110*m*) and transmits a detection signal to the controller 400, corresponding to the sensed indicator and, accordingly, the first display area DS2. The controller 400 loads the image size data corresponding to the second display area DS2 stored in the storage unit 410 to output an image signal of a second size corresponding to the second display area DS2 and provides it to the flexible display panel 100.

Also, as shown in FIG. 4 step (c), if the flexible display panel 100 is further drawn out according to the first direction such that a third display area DS3 that is larger than the second display area DS2 is exposed, a process similar to that described above occurs, and controller 400 outputs an image signal corresponding to the third display area DS3 to the flexible display panel. The flexible display panel 100 may display an optimized image corresponding to the size of the exposed display area by the above-described process. Although only 3 positions of flexible display panel 100 are described here, one of skill in the art will understand that many different positions, corresponding to the number and/or type of indicators is possible, and the controller is capable of displaying an image corresponding to the many possible sizes of the exposed portion of flexible display panel 100.

Figure 5:
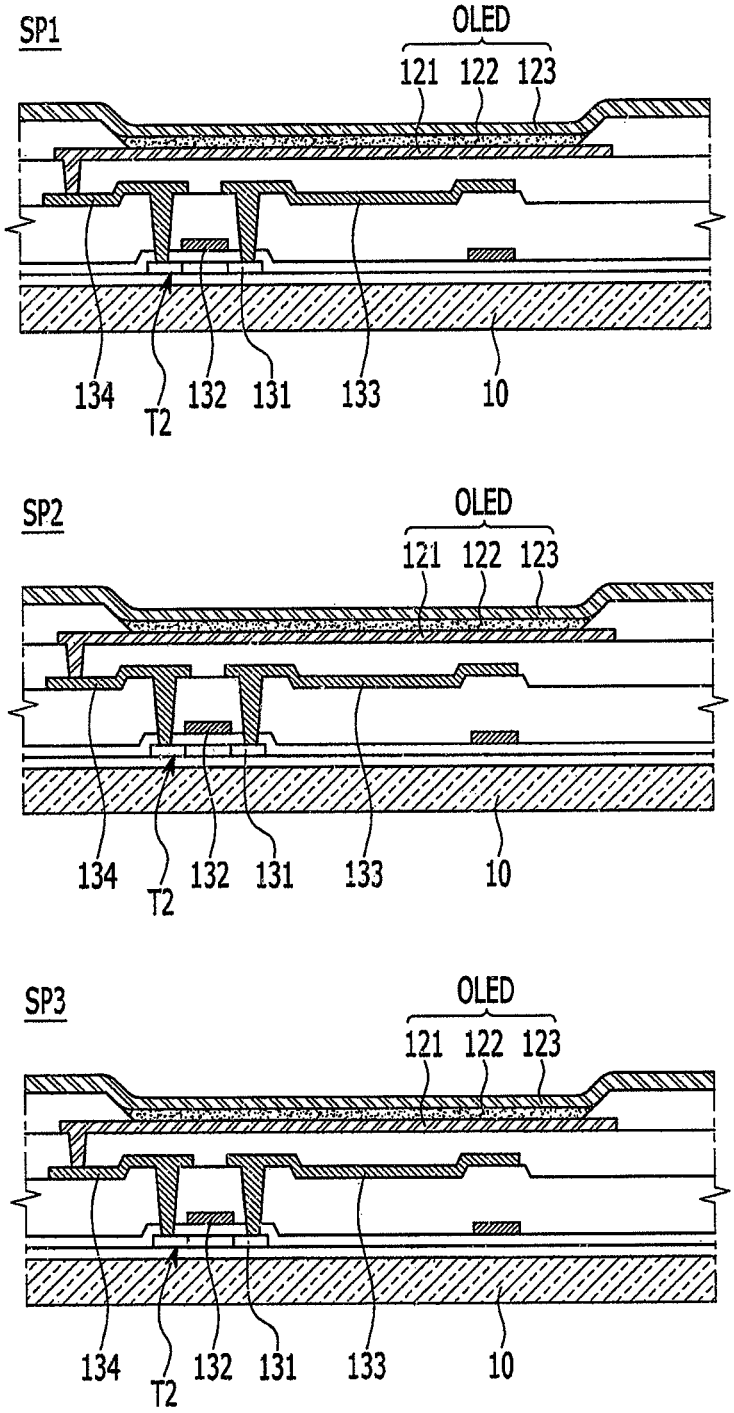
FIG. 5 is an enlarged cross-sectional view of an indicator in the display device shown in FIG. 1.

FIG. 5 is an enlarged cross-sectional view of an indicator in the display device shown in FIG. 1.

Referring to FIG. 5, an embodiment of each of the subpixels SP1, SP2, and SP3 is depicted. One indicator includes red, green, and blue subpixels SP1, SP2, and SP3, respectively, each of the subpixels SP1, SP2, and SP3 includes a substrate 10, driving circuit unit (DCU) and an OLED. The DCU comprises a switching thin film transistor, a driving thin film transistor T2, and a capacitor.

In FIG. 5 the driving thin film transistor T2 and the OLED connected thereto are shown. The driving thin film transistor T2 includes an active layer 131, a gate electrode 132, a source electrode 133, and a drain electrode 134.

Although not shown, in the non-display area NDA of the flexible display panel 100, like the display area DA, a gate line, a data line, and a common power line are disposed. The gate line is disposed according to one direction, and the data line and the common power line intersect the gate line.

The OLED includes a pixel electrode 121, an organic emission layer 122, and a common electrode 123. The organic emission layer 122 is a red emission layer in the red subpixel SP1, it is a green emission layer in the green subpixel SP2, and it is a blue emission layer in the blue subpixel SP3.

In some embodiments, the pixel electrode 121 and the common electrode 123 are hole injection electrodes, and the organic emission layer 122 is an electron injection electrode. When electrons and holes are injected from the pixel electrode 121 and the common electrode 123 to the organic emission layer 122, and excitons, which are a combination of the injected holes and electrons, are changed to a ground state from an exited state, light is emitted.

The switching thin film transistor is operated by a gate voltage applied to the gate line such that a data voltage applied to the data line is transmitted to the driving thin film transistor T2. A voltage corresponding to the difference between the common voltage applied to the driving thin film transistor T2 from the common power line and the data voltage transmitted from the switching thin film transistor is stored to the capacitor. voltage stored in the capacitor generates a current which flows to the OLED through the driving thin film transistor T2, and the organic emission layer 122 emits light.

Figure 6:
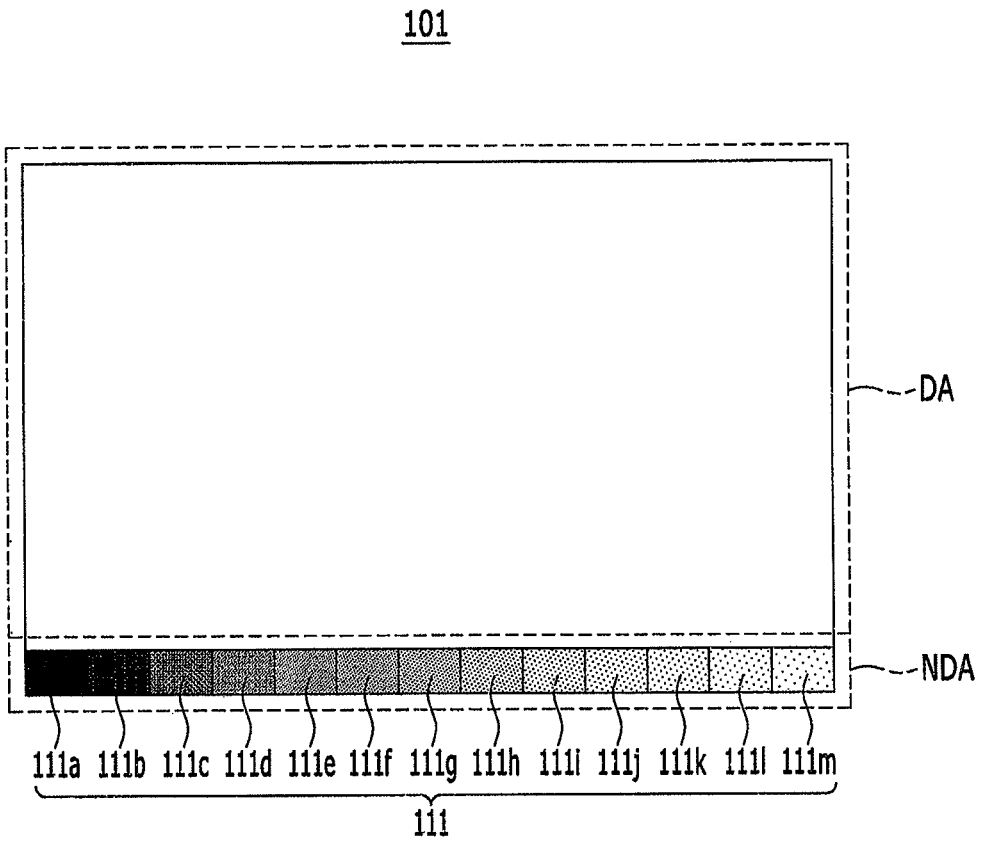
FIG. 6 is a front view of a flexible display panel in a display device according to the second exemplary embodiment.
Figure 7:
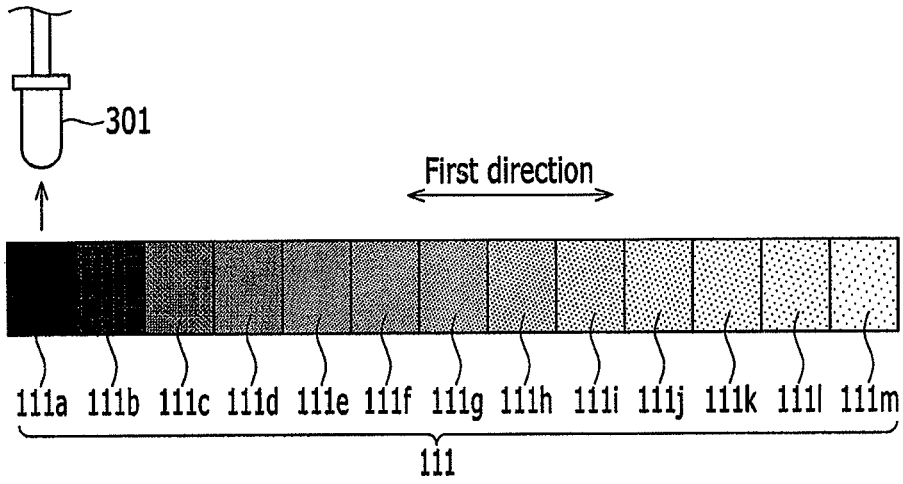
FIG. 7 is a view illustrating an embodiment of a sensing method of a display device.

FIG. 6 is an embodiment of a front view of a flexible display panel in a display device, and FIG. 7 is a view illustrating a sensing method of a display device.

The display device illustrated in FIGS. 6 and 7 have similar features as described herein. Referring to FIGS. 6 and 7, for the display device comprises a plurality of indicators 111*a*-111*m* having different light-emitting intensities.

The plurality of indicators 111*a*-111*m* may express the same color, for example an achromatic color, or a chromatic colors. The plurality of indicators 111*a*-111*m* may have light-emitting intensity that is gradually changed according to the first direction. That is, the light-emitting intensity of the plurality of indicators 111*a*-111*m* may be gradually stronger or weaker from one end of the recognition pattern 111 to the other end.

As described herein, the plurality of indicators 111*a*-111*m* may be self-luminous. The light-emitting intensity of each indicator 111*a*-111*m* controls the current amount from the driving circuit unit to the organic emission layer. Whereas the plurality of indicators 111*a*-111*m* have different light-emitting intensities, in some embodiments, light-receiving sensor 301 is a photosensor configured to sense the intensity of the light emitted from the plurality of indicators 111*a*-111*m*.

When withdrawing flexible display panel 101 from or retracting it to the housing along the first direction, the light-receiving sensor 301 senses the light emitted from the indicators 111*a*-111*m* passing thereunder. Based on the sensed intensity of light from one or more of the plurality of indicators 111*a*-111*m*, light-receiving sensor 301 transmits a signal to the controller. Based on the transmitted signal, the controller recognizes the size of the exposed display area of flexible display panel 101, and controls the size of the image displayed on flexible display panel 101 based on the size of the exposed display area.

In display device 1000 the exposed display area may be precisely sensed by increasing the resolution or number of the indicators (110*a*-110*m*). Similarly, by sensing the intensity of the light, the sensor cost is low and the manufacturing cost may be decreased.

In the display devices described herein, the pixels of the display area DA comprising the portion of flexible display panel 100 which are received inside the housing 200 are turned off or inactivated as they enter housing 200. In some embodiments, the plurality of indicators 110*a*-110*m* and/or 111*a*-111*m* which form the recognition patterns 110 and 111 may be continuously activated for the sensing in real time regardless of whether they are within housing 200 or not.

FIG. 8 is a perspective view of another embodiment of a display device.

In FIG. 8, an embodiment of a display device comprises an approach sensor 500.

As described elsewhere herein, one end of the flexible display panel 100 is coupled to the roll part 210 of the housing 200 and the other end thereof is fixed to a fixing member 220. A user may hold the housing 200 in one hand and the fixing member 220 in the other hand, Further, the user may move the fixing member 220 to control the withdrawing/retracting operations of the flexible display panel 100. The distance between the housing 200 and fixing member 220 changes according to the movement of the users hands. When the flexible display panel 100 is completely rolled onto the roll part 210, fixing member 220 and housing 200 are in contact.

Figure 8A:
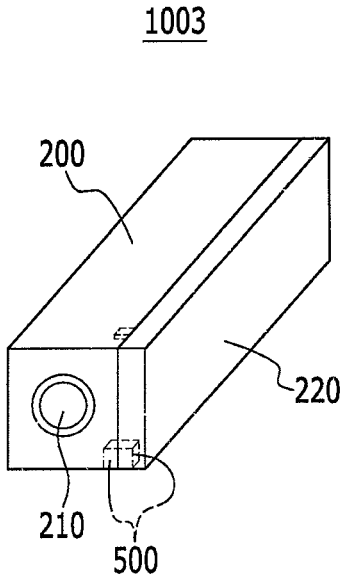
FIG. 8A-B is a perspective view of an embodiment of a display device.

A pair of approach sensors 500*a* and 500*b* are installed one in each of the housing 200 and the fixing member 220, respectively. The pair of approach sensors 500*a* and 500*b* are aligned such that when the flexible display panel 100 is completely rolled to the roll part 210 such that the housing 200 and the fixing member 220 contact, the pair of approach sensors 500*a*-*b* mutually contact thereby generating a closed signal, as depicted in FIG. 8A. The pair of approach sensors 500 may be sensors using a magnet, or a sensor of various structures generating a signal under mutual contact may be used.

The controller 400 receives the closed signal of the approach sensor 500, and if no operation is performed during a predetermined time after the closing signal is input, the gate signal of the indicators (110*a*-110*m*) is inactivated such that all indicators (110*a*-110*m*) are turned off. The display device 1003 then enters a power-saving mode thereby reducing power consumption.

Figure 8B:
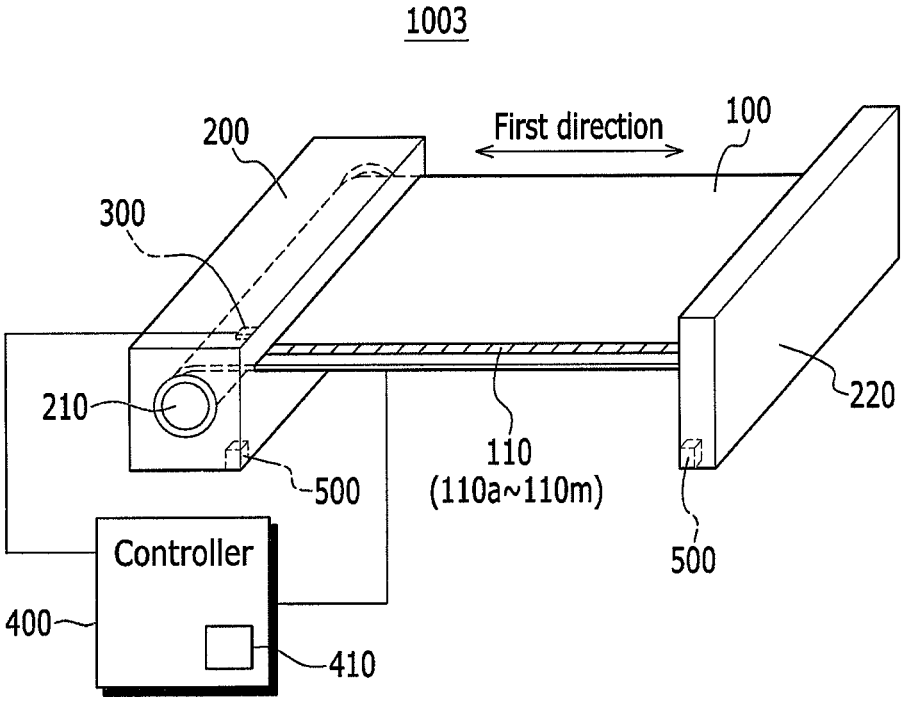

When the flexible display panel 100 is unfolded such that the pair of approach sensors 500*a*-*b* move away from each other, as depicted in FIG. 8B an open signal is generated from approach sensors 500*a*-*b*, and this signal is transmitted to the controller 400. The controller 400 supplies the gate signal and the data signal to the plurality of indicators 110*a*-110*m* to turn on all indicators 110*a*-110*m*.

Figure 9:
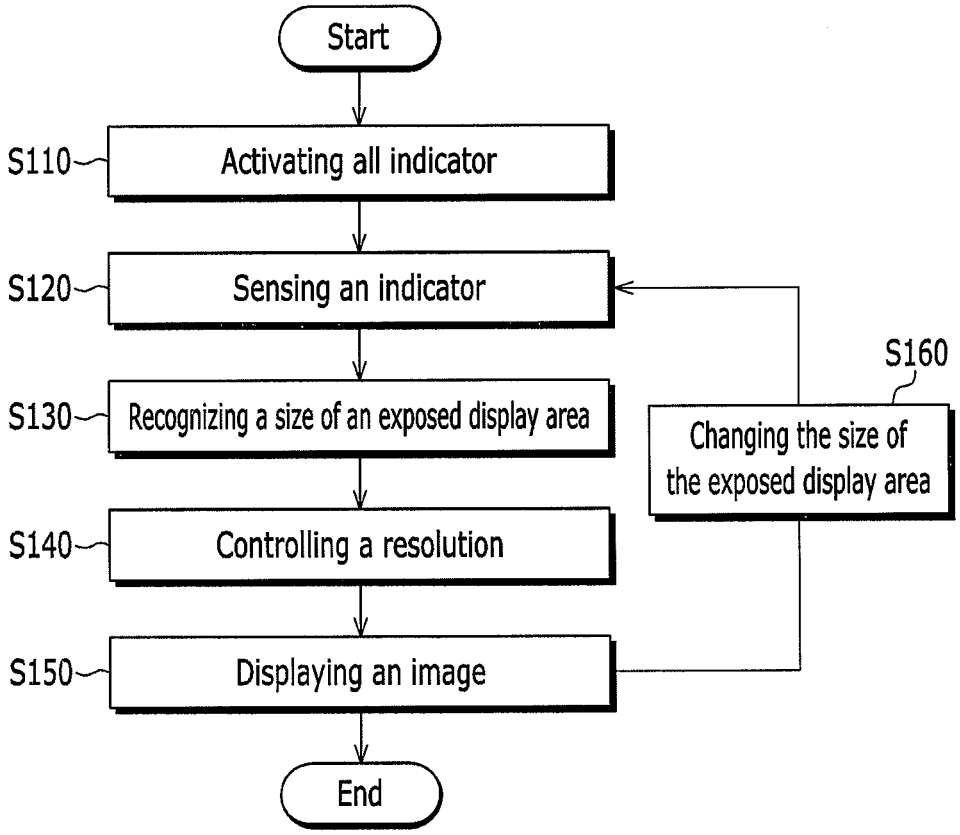
FIG. 9 is a flowchart of an embodiment of a driving method of a display device.

FIG. 9 is a flowchart of an embodiment of a driving method of a display device. This driving method may be performed by using a display device as described herein.

Referring to FIG. 9, in step S110, when power is turned on, all indicators forming the recognition pattern are activated, emitting, for example, light with a predetermined range of colors or intensity. The gate signal and the data signal are applied to all indicators such that all indicators are turned on.

In step S120, if the withdrawing/retracting operation of the flexible display panel is performed along the first direction, the light-receiving sensor senses the color of the special indicator passing thereunder or the intensity of the light. In step S130, the detection signal of the light-receiving sensor is transmitted to the controller, and the controller recognizes the size of the exposed display area corresponding to the sensed indicator S130. At this time, the storage unit stores the image size data respectively corresponding to the exposed display area.

Next, in step S140, the controller loads the image size data corresponding to the exposed display area from the storage unit such that the image signal of which the resolution is controlled is output. In step S150, the flexible display panel displays the image on the exposed display area. In step S160, if the flexible display panel is withdrawn from the housing or retracted into the housing, along the first direction such that the size of the exposed display area is changed, steps S120 to S150 are repeated.

In some embodiments, the driving method is a method in which the light-receiving sensor recognizes the sequence of the special indicators for a plurality of all indicators, or senses the entire area after the flexible display panel is discharged from the housing by using ultraviolet (UV) or infrared rays. In some embodiments, the driving method may count the number of rotations of the roll part to sense the exposed display area.

In some embodiments, the display device senses the special indicator passing under the light-receiving sensor in real time such that the display area of the flexible display panel corresponding to each indicator may be correctly recognized.

Accordingly, the driving method does not need to monitor of the movement of the flexible display panel and may correctly sense the exposed display area outside the housing although the flexible display panel is non-linearly bent. Also, when the power is suddenly turned off and on or when the flexible display panel 100 is unfolded and a part of it is folded, an image of a size corresponding to the exposed display area may be displayed.

Figure 10:
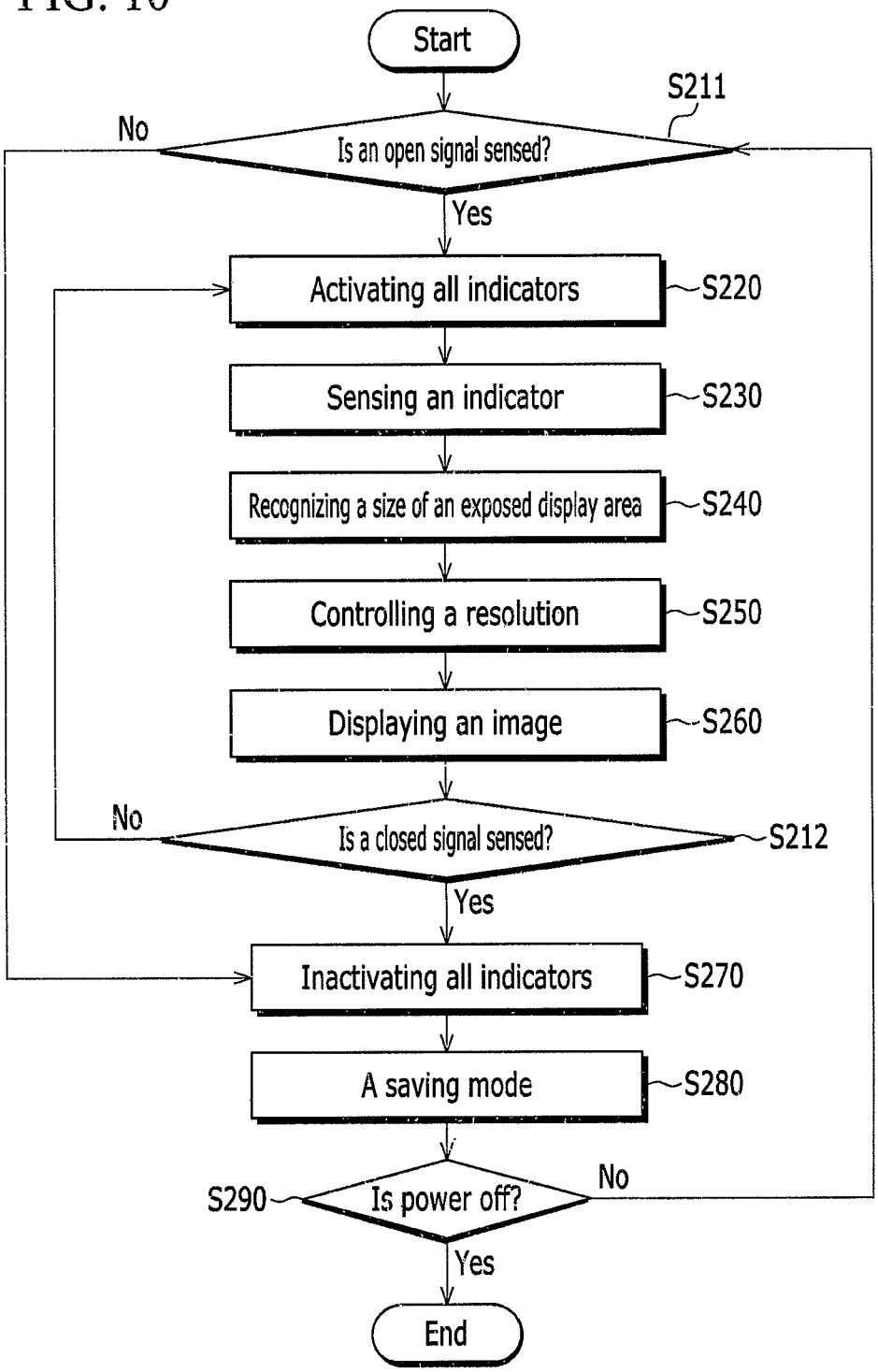
FIG. 10 is a flowchart of another embodiment of a driving method of a display device.

FIG. 10 is a flowchart of another embodiment of a driving method of a display device. This driving method may be performed by using a display device as described herein.

Referring to FIG. 10, in step S211, power is turned on and it is confirmed whether the approach sensor shows an open state. If the open state is shown, all indicators forming the recognition pattern are applied with the gate signal and the data signal such that all indicators are activated in step S220.

When the withdrawing/retracting operation of the flexible display panel is performed along the first direction, the light-receiving sensor senses the color of the special indicator passing thereunder or the intensity of the light, in step S230. The detection signal of the light-receiving sensor is transmitted to the controller, and the controller recognizes the size of the exposed display area corresponding to the sensed indicator in step S240.

Next, in step S250, the controller controls the resolution of the image based on the exposed display area, and loads the image size data based on the resolution. In step S260, the flexible display panel displays the image on the exposed display area.

If, however, the approach sensor is in the closed state, in step S212, the gate signal and the data signal of the indicators are blocked such that all indicators are inactivated in step S270. Thus, if an open state is not recognized in step S211, step S270 is performed. If the closed state is not recognized in step S212, steps S220 to S260 are repeated.

If the all indicators are inactivated, the power-saving mode is performed in step S280. In step S290, if the power is off, the method ends. If the power is not off, step S211 is performed. For example, if the saving mode is maintaining for a predetermined time, the power may be automatically turned off.

Figure 11:
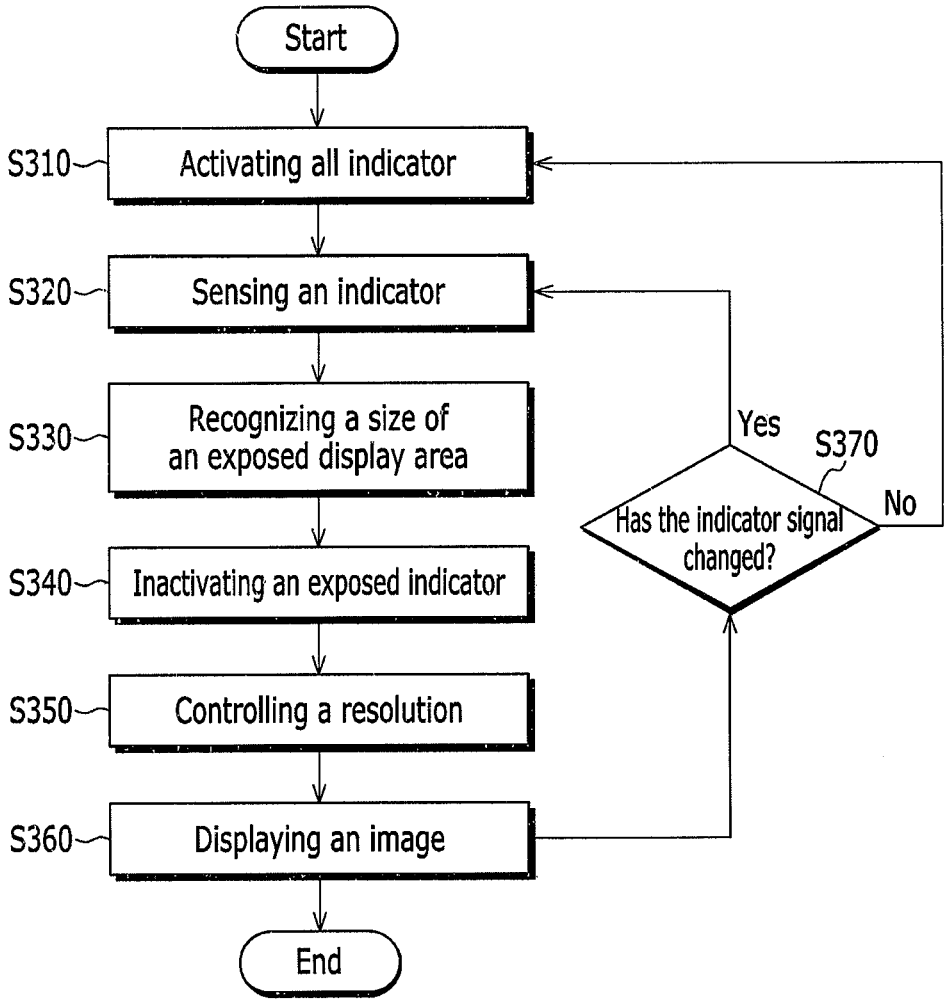
FIG. 11 is a flowchart of another embodiment of a driving method of a display device.

FIG. 11 is a flowchart of another embodiment of a driving method of a display device. This driving method may be performed by using a display device as described herein.

Referring to FIG. 11, in step S310, when the power is turned on, all indicators forming the recognition pattern are activated such that the previously determined color is displayed or light is emitted with the previously determined intensity. If a withdrawing/retracting operation of the flexible display panel is performed along the first direction, the light-receiving sensor senses the color of the special indicator passing thereunder or the intensity of the light in step S320. In step S330, the detection signal of the light-receiving sensor is transmitted to the controller, and the controller recognizes the size of the exposed display area corresponding to the sensed signal.

Next, in step S340, the data signal for the indicators exposed outside the housing among a plurality of indicators is blocked such that the exposed indicators are inactivated. Accordingly, the activated indicators being recognized as defective pixels when the image is displayed on the exposed display area of the flexible display panel may be prevented.

Next, the controller loads the image size data corresponding to the exposed display area from the storage unit to output the image signal of which the resolution is controlled in step S350. In step S360, the flexible display panel displays the image on the exposed display area.

At this time, the indicators received inside the housing among a plurality of indicators are activated. Accordingly, if the flexible display panel is currently further draw out in the drawn-out state, in the step S320, the light-receiving sensor may sense the color of the indicator or the intensity of the light without a problem. However, when the flexible display panel is rewound in the current state, that is, when receiving the flexible display panel, the exposed indicators are inactivated such that the inactivated indicators must be activated.

In step S370, if an indicator of a different color or a different light emitting intensity is sensed, it means that the flexible display panel is further drawn out from the current state. In this case, steps S320 to S360 are repeated.

If other indicators are not sensed with reference to the currently sensed indicators, this means that the flexible display panel is rewinding in the current state. In this case, the process moves to step S310 activating all indicators, and steps S320 to S360 are repeated. That is, if the light-receiving sensor senses the indicator and then light subsequently not sensed, the inactivated indicators are directly activated.

Figure 12:
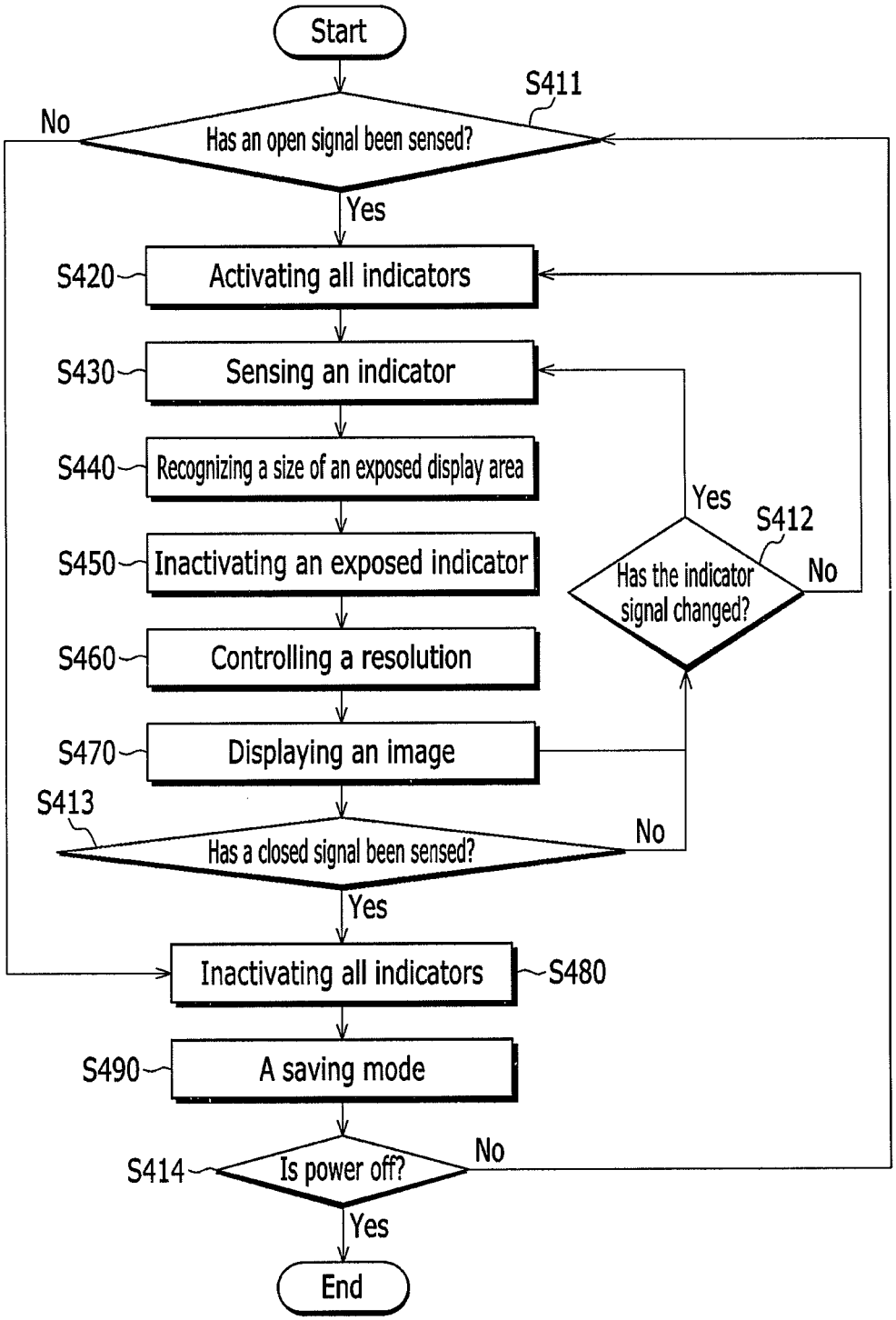
FIG. 12 is a flowchart of another embodiment of a driving method of a display device.

FIG. 12 is a flowchart of yet another embodiment of a driving method of a display device. This driving method may be performed by using the display devices described herein.

Referring to FIG. 12, power is turned on and, in step S411, it is confirmed whether the approach sensor is in the opening state. If it is in an opening state, all indicators forming the recognition pattern are applied with the gate signal and the data signal and all indicators are activated in step S420.

If the withdrawing/retracting of the flexible display panel is performed along the first direction, the light-receiving sensor senses the color of the special indicator passing thereunder or the intensity of the light in step S430. The detection signal of the light-receiving sensor is transmitted to the controller, and the controller recognizes the size of the exposed display area corresponding to the sensed indicator in step S440.

Next, the data signal for the indicators exposed outside the housing among the plurality of indicators is blocked such that the exposed indicators are inactivated in step S450. Accordingly, the activated indicators being recognized as defective pixels when the image is displayed on the exposed display area of the flexible display panel may be prevented.

Next, in step S460 the controller controls the resolution of the image based on the exposed display area, and loads the image size data based on the resolution. In step S470, the flexible display panel displays the image on the exposed display area.

If indicators of a different color or intensity are sensed in step S412, it means that the flexible display panel is further drawn out from the current state. In this case, steps S430 to S470 are repeated.

If other indicators are not sensed with reference to the currently sensed indicators, this means that the flexible display panel is rewinding in the current state. In this case, step S420 is performed, activating all indicators, and steps S430 to S470 are repeated. That is, if the light-receiving sensor senses the indicator and then the light is no longer sensed, the inactivated indicators are directly activated.

If it is confirmed that the approach sensor is the closing state S413, and it is in the closing state, the gate signal and the data signal of the indicators are blocked such that all indicators are inactivated S480. If the opening state is not recognized in the step S411, the step S480 is performed, while if the closing state is not recognized in the S413, the steps S430 to S470 are repeated through the step 412.

If the all indicators are inactivated, the power saving mode is entered in S490. In step S414 it is determined whether the power is turned off. For example, if the saving mode is maintaining for a predetermined time, the power may be automatically turned off.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a self-luminous flexible display panel moveable along a first direction, comprising a recognition pattern, the recognition pattern comprising a plurality of indicators;

a housing coupled to the flexible display panel, configured such that as the flexible display panel is withdrawn from the housing or retracted into the housing along the first direction, a display area of the flexible display panel, is variably exposed; and a light-receiving sensor positioned in the housing corresponding to the recognition pattern configured to recognize one of the plurality of indicators and sense the exposed display area of the flexible display panel; and a controller in electrical communication with the light-receiving sensor and the flexible display panel, the controller configured to display a variable-size image on the flexible display panel, the displayed image having a variable-size area, wherein the variable-size area of the displayed image corresponds to the sensed exposed display area of the flexible display panel;

wherein the display area of the flexible display panel includes a display area comprising a plurality of pixels configured to display an image and a non-display area near the display area, and wherein the recognition pattern is positioned in the non-display area; and wherein the plurality of indicators are pixels respectively having different colors, and the light-receiving sensor is configured to sense the color of the plurality of indicators to sense the exposed display area.

2. The display device of claim 1, wherein the controller includes a storage unit storing image size data respectively corresponding to the display area of the flexible display panel.

3. The display device of claim 1, wherein the plurality of indicators include subpixels of red, green, and blue.

4. The display device of claim 3, wherein a portion of pixels of the plurality of pixels formed in the flexible display panel are respectively allocated as indicators.

5. The display device of claim 3, wherein the plurality of indicators include a driving circuit unit and an organic light emitting diode (OLED) connected to the driving circuit unit.

6. The display device of claim 1, wherein the plurality of indicators respectively have different light-emitting intensities, and the light-receiving sensor includes a light-receiving photosensor configured to sense the light intensity of the plurality of indicators.

7. The display device of claim 6, wherein the plurality of indicators represent the same color and have light-emitting intensity that varies gradually along the first direction.

8. The display device of claim 1, further comprising:

a roll part positioned inside the housing and fixing one end of the flexible display panel; and a fixing member fixing the other end of the flexible display panel.

9. The display device of claim 8, further comprising a pair of approach sensors, wherein one of the pair of approach sensors is installed in housing and the other of the pair of approach sensors is installed in the fixing member toward the housing, the pair of approach sensors configured to sense when the flexible display panel is disposed substantially entirely within housing, based on the distance between the housing and the fixing member.

10. A method of driving a display device, comprising:

providing the display device according to claim 1;

activating the plurality of indicators;

recognizing a color of one indicator among the plurality of indicators using the light-receiving sensor to determine an exposed display area of the flexible display panel;

generating an image signal corresponding to the display area; and displaying the image in the display area of the flexible display panel.

11. The method of claim 10, further comprising inactivating the indicators among the plurality of indicators exposed outside the housing before the flexible display panel displays the image.

12. The method of claim 11, further comprising:

determining whether another indicator is sensed after the flexible display panel displays the image; and activating the plurality of indicators if another indicator is not sensed with reference to the currently sensed indicator.

13. A method of driving a display device, comprising:

providing the display device according to claim 9;

determining whether an approach sensor is in an open state;

activating a plurality of indicators if the approach sensor is in the open state;

recognizing one indicator among the plurality of indicators through the light-receiving sensor to sense an exposed display area of the flexible display panel;

generating an image signal corresponding to the display area;

displaying an image from the image signal on the display area of the flexible display panel; and determining whether the approach sensor is in a closed state to inactivate the plurality of indicators if the approach sensor is in the closed state, thereby initiating a power-saving mode.

14. The method of claim 13, further comprising inactivating the indicators among the plurality of indicators which are exposed outside the housing before the flexible display panel displays the image.

15. The method of claim 14, wherein:

after the flexible display panel displays the image, determining whether another indicator is sensed with reference to the currently sensed indicator; and activating a plurality of indicators if another indicator is not sensed with reference to the currently sensed indicator.

16. A display device comprising:

a self-luminous flexible display panel moveable along a first direction, comprising a recognition pattern, the recognition pattern comprising a plurality of indicators;

a housing coupled to the flexible display panel, configured such that as the flexible display panel is withdrawn from the housing or retracted into the housing along the first direction, a display area of the flexible display panel, is variably exposed; and a light-receiving sensor positioned in the housing corresponding to the recognition pattern configured to recognize one of the plurality of indicators and sense the exposed display area of the flexible display panel; and a controller in electrical communication with the light-receiving sensor and the flexible display panel, the controller configured to display a variable-size image on the flexible display panel, the displayed image having a variable-size area, wherein the variable-size area of the displayed image corresponds to the sensed exposed display area of the flexible display panel;

wherein the display area of the flexible display panel includes a display area comprising a plurality of pixels configured to display an image and a non-display area near the display area, and wherein the recognition pattern is positioned in the non-display area; and wherein the plurality of indicators are pixels respectively having different light-emitting intensities, and the light-receiving sensor includes a light-receiving photosensor configured to sense the light intensity of the plurality of indicators to sense the exposed display area.

* * * * *